United States Patent [19]

D'Amato et al.

[11] 3,982,453

[45] Sept. 28, 1976

[54] METHOD OF ASSEMBLING NUMBERED DOCUMENTS IN ORDER

[75] Inventors: Salvatore F. D'Amato, Floral Park; Francis T. Moss, Woodside, both of N.Y.

[73] Assignee: American Bank Note Company, New York, N.Y.

[22] Filed: July 15, 1974

[21] Appl. No.: 488,448

[52] U.S. Cl. ..... 83/23; 83/79; 83/112; 53/123; 198/362

[51] Int. Cl.[2] ..... B26D 7/06; B65B 63/00

[58] Field of Search ..... 198/37, 38, 40, 31 R, 198/31 AC, 32, 34, 76, 26, 78, 79, 21; 221/93, 292, 293, 298; 83/102, 408, 23, 79, 112; 53/123; 214/11 R, 16 B; 100/2, 6, 8; 270/52, 54, 58

[56] References Cited

UNITED STATES PATENTS

| | | | |
|---|---|---|---|
| 1,992,686 | 2/1935 | Anderson | 198/38 |
| 2,332,316 | 10/1943 | Hexter et al. | 53/123 |
| 3,118,549 | 1/1964 | Hoellen | 214/16 B |
| 3,272,353 | 9/1966 | Wilder | 198/38 |
| 3,496,816 | 2/1970 | Doerfler et al. | 83/102 |
| 3,841,205 | 10/1974 | Niehaus | 198/38 |

*Primary Examiner*—John J. Love
*Assistant Examiner*—Joseph E. Valenza
*Attorney, Agent, or Firm*—Cooper, Dunham, Clark, Griffin & Moran

[57] ABSTRACT

This method and apparatus starts with a lot of distinctively numbered documents consisting of a plurality of stacks of sheets, each sheet bearing multiple reproductions of the document. The documents in corresponding locations of successive sheets in the stack are in consecutive numerical order. In each sheet, the documents are arranged by rows and columns in an arbitrary, nonconsecutive numerical order in which successive members of the order bear numbers separated by a fixed difference. The method involves separating the stacks of documents into a plurality of piles, each pile having its documents in consecutive numerical order, but with the corresponding documents in successive piles separated by said fixed difference. The piles from successive stacks are deposited on successive ones of a plurality of tributary conveyors, all of which deliver their piles to a main conveyor. The delivery of the documents from the tributary conveyors to a loading run of the main conveyor is gated so that each tributary conveyor delivers one pile at a time to the main conveyor. The gates can open only when there is a pile awaiting delivery at every gate and when the loading run of the main conveyor is unoccupied. The piles are deposited on the main conveyor with their documents consecutively numbered from one pile to the next. Two stages of tributary conveyors and main conveyors are provided for handling large consecutive sequences of numbers.

7 Claims, 15 Drawing Figures

CUTTER
CUTTER
STACKS OF UNCUT NOTES ON PALLETS
INCOMING FLOW

Fig. 4.
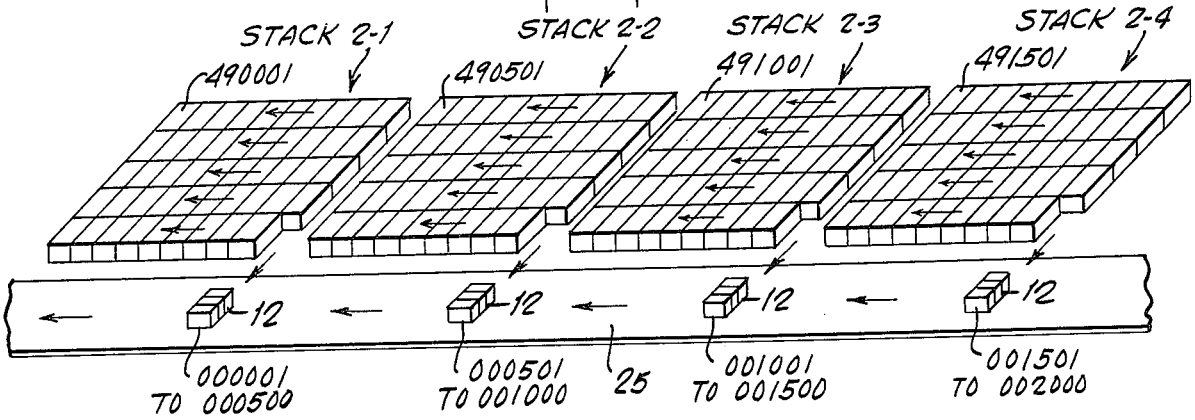
Fig. 5.
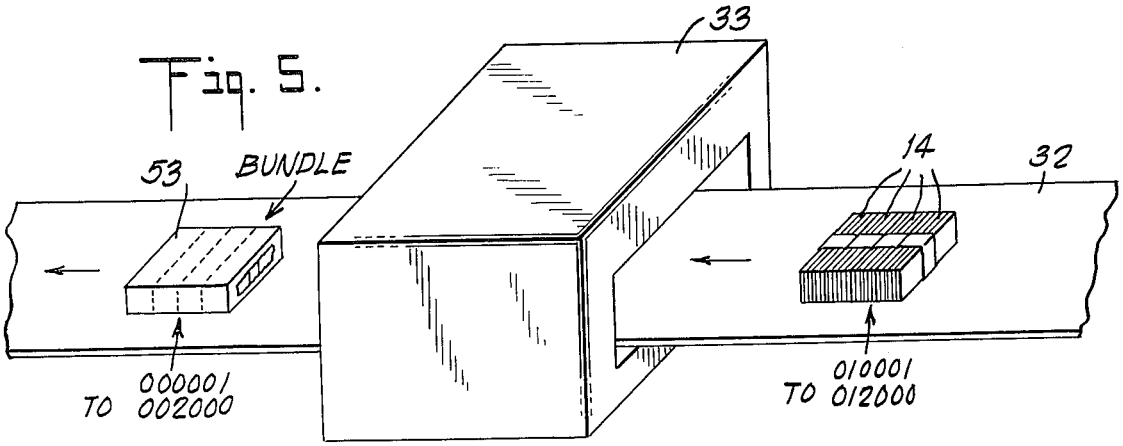
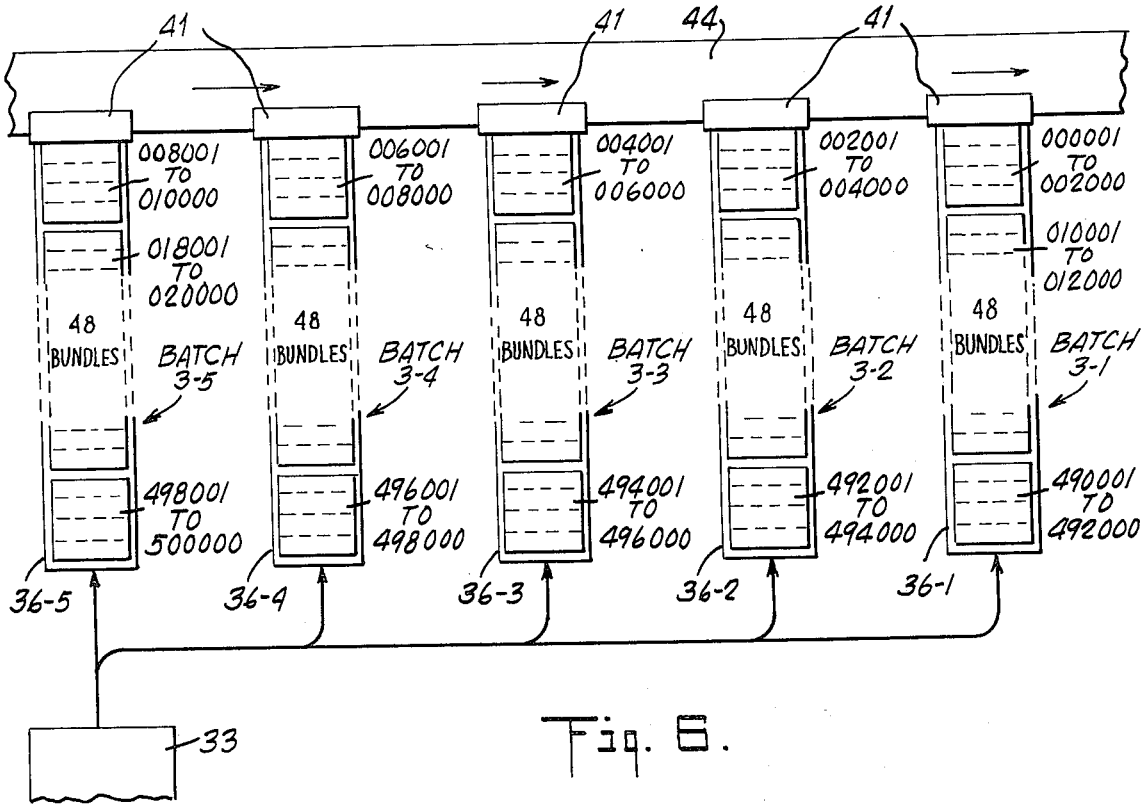
Fig. 6.

METHOD OF ASSEMBLING NUMBERED DOCUMENTS IN ORDER

BRIEF SUMMARY OF THE INVENTION

Documents of value, such as bank notes, are commonly printed on sheets with a large number of documents (e.g., 50) on a sheet. In the printing operation, the notes are numbered by passing through a numbering machine having a plurality of numbering heads equal to the number of notes on a sheet. Each numbering head applies a number to one document on each sheet, and applies consecutive numbers to documents on consecutive sheets. The respective numbering heads operate with different sequences of numbers. For example, if there are fifty documents on a sheet and the total lot of documents is 500,000, then each numbering head operates through a separate set of 10,000 consecutive numbers. The sets will be consecutive, so that the complete lot has 500,000 consecutive numbers, with each note distinctively numbered.

It is desirable for the bank notes to be delivered to the customer in packages, each containing notes bearing all the numbers within a consecutive set.

In the past, it has been the practice to arrange the sheets in stacks of 500 and cut each stack into fifty individual piles of consecutively numbered documents. The assembly of these piles from various stacks of 500 into packages of say 10,000 consecutively numbered documents has heretofore been accomplished by hand. This has entailed a considerable amount of manual labor, and involves numerous opportunities for error. The method and apparatus of the present invention is semi-automatic. Some of the operations are performed manually, and others are automatic. Nevertheless, the final product is a series of packages, each of which contains documents bearing all the numbers within a consecutive set. The documents are preferably but not necessarily arranged in consecutive numerical order within each package.

The method begins, like the old manual method, by separating the lot of printed sheets into stacks typically of 500 sheets each, the number being selected as the largest number which can conveniently be handled in a conventional paper cutter. Each stack is then placed in the cutter and is there cut into fifty or so piles of 500 consecutively numbered documents. The number of piles is the number of notes printed on each sheet. Each pile of consecutively numbered documents is then passed through a banding machine which places a transparent band around the pile to hold it together during further operations. The piles from each stack are then, after banding, deposited on the receiving end of one of a plurality of tributary conveyors. The number of tributary conveyors available determines the maximum number of stacks of sheets which may be handled at one time as a single batch. In the example illustrated, there are four tributary conveyors. Hence, each batch consists of four stacks, and four operators are required to band the piles of documents and place them on the tributary conveyors.

The tributary conveyors deliver the banded piles of documents to a loading run of a main conveyor. At the discharge end of each tributary conveyor, there is provided a gate mechanism which allows the passage of only one banded pile at a time. These gate mechanisms for all the tributary conveyors are controlled so that they deliver banded piles to the main conveyor concurrently, and only when there is at least one banded pile ready for delivery at each gate, and when there are no banded piles on the loading run of the main conveyor.

The tributary conveyors and the main conveyor as described above constitute a first stage of assembly of the documents. A group of piles, one from each of the tributary conveyors, are carried down the main conveyor to a wrapping station. There the group of four piles, which are in a consecutive numerical order, are wrapped together and directed to one of a plurality of second stage tributary conveyors, equal in number to the number of batches in a lot. All of the documents originating in one batch of stacks are delivered to a single second stage tributary conveyor. After a number of batches have been delivered sufficient to fill all but the last (the last must have received at least one pile) of the second stage tributary conveyors, those conveyors start delivering to a second stage main conveyor through another set of one only gates similar to those which control the delivery of the piles from the first set of tributary conveyors. The second set of tributary conveyors deliver the wrapped packages to the second stage main conveyor in groups which contain all the numbers within a consecutively numbered set. It is desirable that all the numbered documents within a group be in consecutive numerical order, but this is not always the case. The second stage main conveyor carries the groups of wrapped packages to a packing station, where each group is placed in a carton having the required capacity.

DRAWINGS

FIG. 1 is a diagrammatic view showing how FIGS. 1a and 1b fit together.

FIGS. 1*a* and 1*b* taken together show a diagrammatic plan view of apparatus in which the method of the invention may be carried out.

FIG. 1*c* is an expanded diagrammatic view of a portion of FIG. 1*b*, showing the controls for the entrance gates of the secondary conveyors.

FIG. 4 is a somewhat diagrammatic perspective view showing the sequence in which the first piles from each of a batch of four stacks move from their respective stacks on to the first stage main conveyor.

FIG. 5 is a diagrammatic perspective view showing a group of four banded piles moving through a wrapper and emerging as a wrapped bundle.

FIG. 6 is a plan view, similar to part of FIG. 1*b* but on a larger scale, showing the numerical sequence in which the bundles move from the wrapper through the second stage tributary conveyors to the second stage main conveyor.

DETAILED DESCRIPTION

FIGS. 1–3

Figure 2:
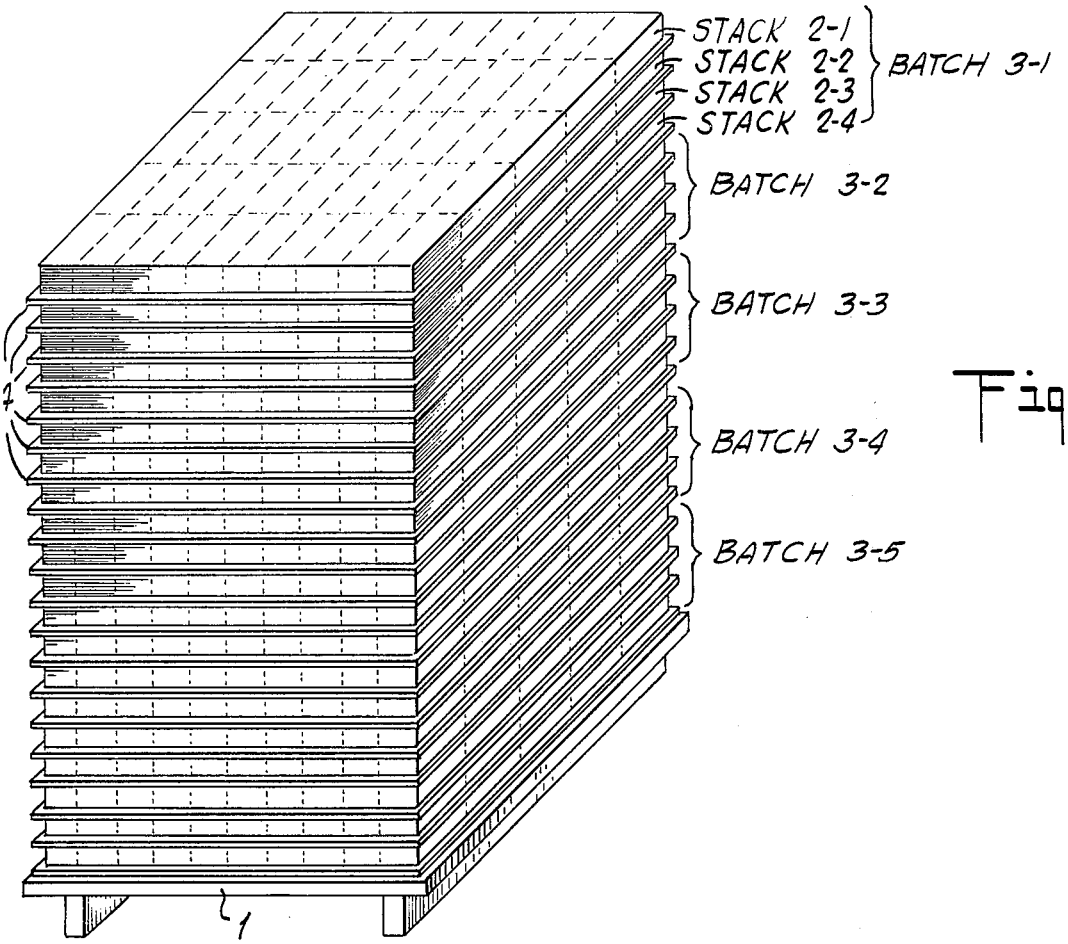
FIG. 2 is a perspective view of a pallet mounted lot of sheets to be cut apart and arranged in sequence in accordance with the invention.

A lot of printed sheets ready to be cut and assembled in numerical order consists of at least one pallet load, such as shown in FIG. 2. That figure illustrates a pallet 1 supporting a load consisting of twenty superimposed stacks 2. Each stack is numbered with a hyphenated number, such as 2-1, 2-2 and so on up to 2-20. The numeral 2 at the beginning of this hyphenated designation identifies the element in question as a stack, and the second part of the hyphenated number distinguishes each stack in the load from the other stacks.

The stacks are moved through the apparatus illustrated in batches 3, each batch consisting of four stacks. Each batch also has a hyphenated number, such as 3-1, 3-2 and so on up to 3-5. The numeral 3 indicates that the element in question is a batch and the second part of the hyphenated number simply distinguishes each batch from the others. A lot consists of at least one pallet load (See Glossary). The pallet load illustrated in FIG. 2 includes twenty stacks which typically contain 500 sheets each. The number of sheets in a stack is selected for convenience in the cutting operation. Each stack 2 rests on a board 4 which may be a sheet of paperboard. This paperboard, besides maintaining the stack divisions, serves to preserve the pile relationship of the stack after cutting, since the blade of the cutter penetrates only the upper surface of the paperboard.

Figures 1, 1A, 1B:
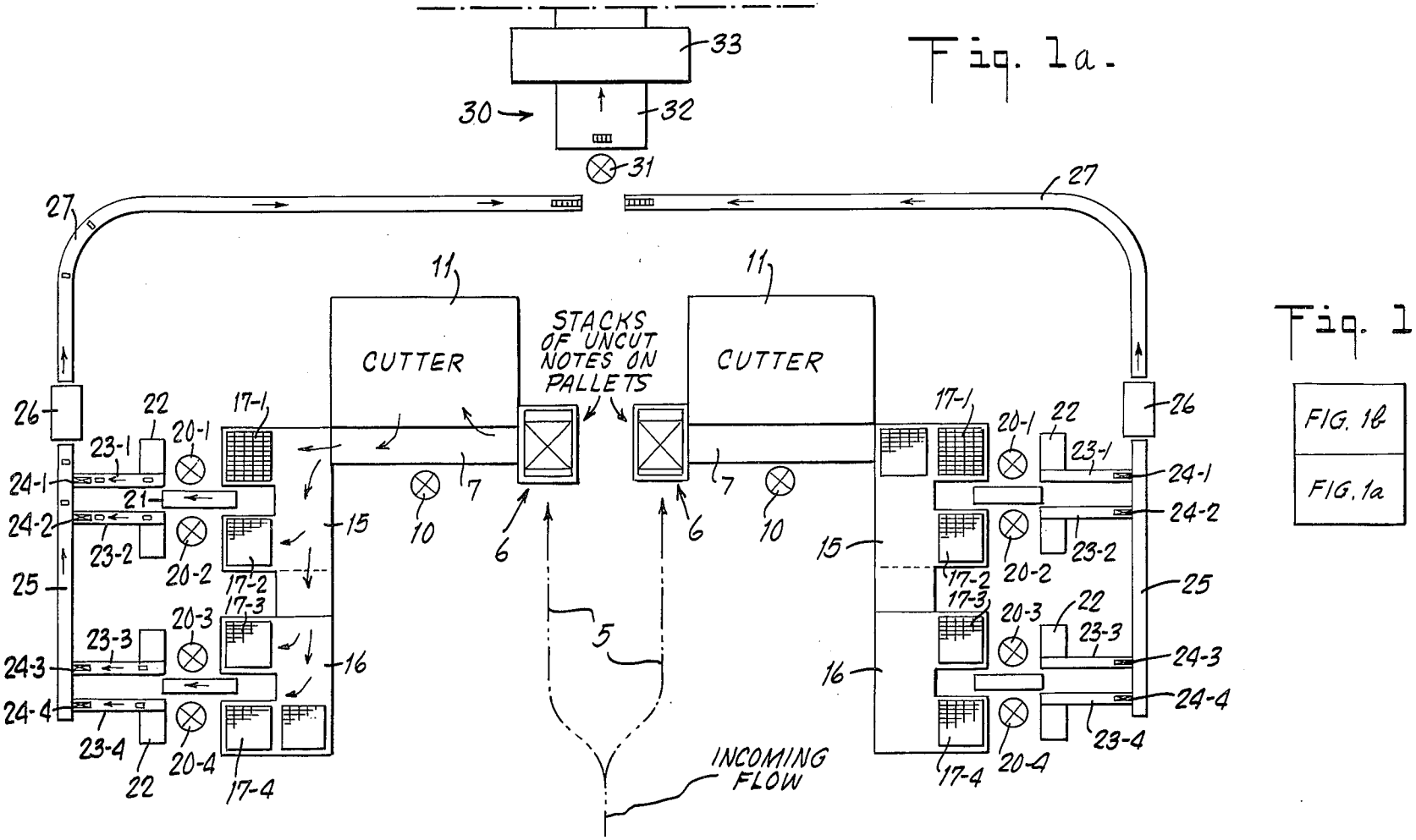

As shown in FIG. 1, the pallet loads are moved along paths indicated by chain lines 5 to unloading stations generally indicated at 6. The pallets are unloaded there from the lift trucks which have been transporting them and are placed on elevator supports which maintain the uppermost stack at substantially the same level as an adjacent table 7, which may conveniently be a ball table. An operator shown diagrammatically at 10 moves each stack along the ball table and guides it through a conventional paper cutter 11 where the stack is cut along the lines indicated in FIG. 3 into fifty piles. The number of piles is determined, of course, by the number of repeats on each sheet of the note or document being printed.

The bank notes in each pile are consecutively numbered from top to bottom. A pile 12 which is shown separated from stack 2-1 and encircled by a band 13 has a top note bearing the number 000001 and a bottom note bearing the number 000501. The next adjacent pile, shown at 14 in FIG. 3, has a top note bearing the number 010001 and a bottom number note bearing the number 010501. It may be seen that the numbers of the corresponding notes, e.g., top notes, in adjacent piles are separated in each case by a difference of 10,000. In the illustrated example, this difference is determined by the fact that the lot consists of a single pallet loaded as shown in FIG. 2 and the pallet load consists of 10,000 sheets. The difference between numbers on adjacent notes in a sheet is equal to the number of sheets in the lot.

Figure 3:
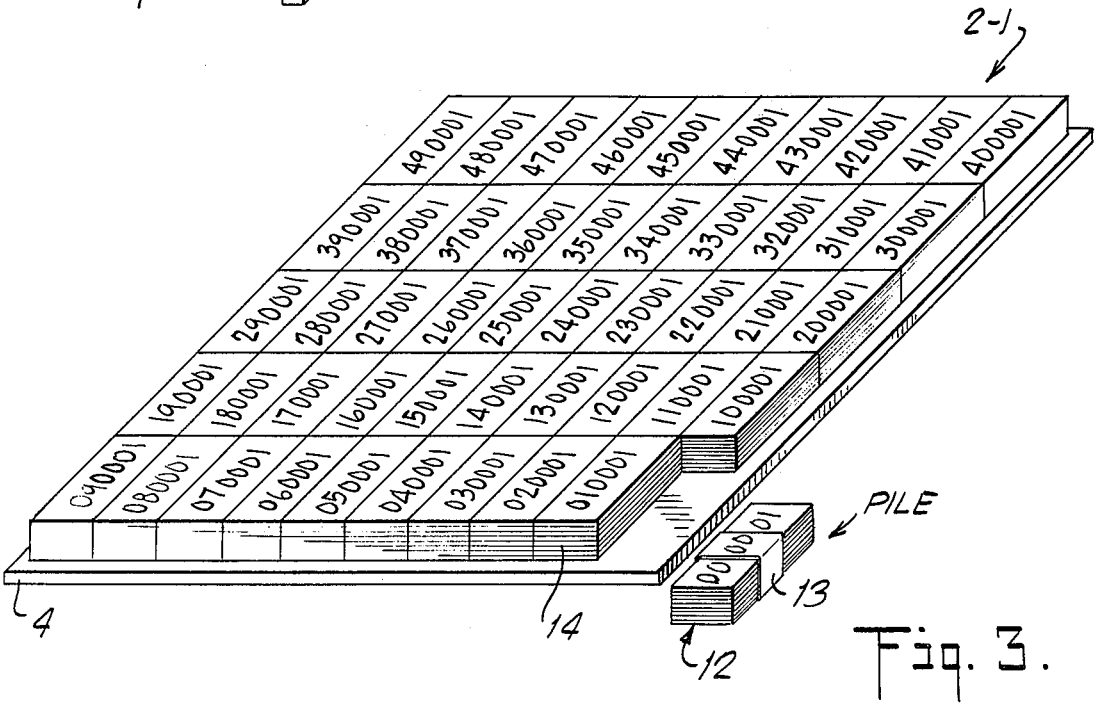
FIG. 3 is a perspective view of a single stack from the lot of FIG. 2 showing how the stack is cut into piles of documents and showing one pile separated from the stack and banded.

After a stack has been cut as shown in FIG. 3 at the cutter 11, a board, which may be Masonite, is inserted under the paperboard 4 for convenience in handling. The cut stack is moved along the ball table 7 and one or more other ball tables 15 and 16 to one of four banding stations identified as 17-1, 17-2, 17-3 and 17-4. The stacks must be moved to the banding stations in sequence, i.e., stacks 2-1 to station 17-1, 2-2 to 17-2, 2-3 to 17-3 and 2-4 to 17-4. Each banding station is attended by an operator 20-1 to 20-4. Each pair of banding stations 17-1 and 17-2 is provided with a conventional banding machine 21 which is used by both of the operators 20 seated on oppsosite sides of it. Each operator 20 is provided with a work table 22 and has access to the receiving end of a tributary conveyor 23. Four such conveyors 23 are supplied, one for each of the four banding stations 17-1 to 17-4. The tributary conveyors are numbered 23-1 to 23-4. After banding a pile, the operator places it on the adjacent tributary conveyor. The tributary conveyors 23 discharge the banded piles through a gate 24 on to a loading run 25 of a main conveyor. A gate 24 is shown in greater detail in FIG. 9 and the loading run 25 is shown in greater detail in FIG. 10. The gates are numbered 24-1 and 24-4 corresponding to the numbers of the banding stations 17-1 to 17-4 which they serve.

The conveyor 25 moves the banded piles along to a ramp conveyor 26 and thence along another conveyor 27 to a wrapping station generally indicated at 30 (FIG. 1*a*). The wrapping station 30 is manned by an operator 31 who takes groups of banded piles from the two conveyors 27 which feed into the wrapping station. Each group of banded piles is transferred by the operator to a conveyor 32 which carries the group of banded piles through a conventional wrapping machine 33 where they are wrapped with a transparent sheet, typically a shrink wrapped plastic sheet, to form bundles. The bundles leaving the conveyor 32 move to a diverting conveyor 34 (see FIG. 1*b*) which is shiftable under the control of the operator 31 so as to deliver the bundles, consistent with the hand of its origin, either to a left-hand bank of secondary tributary conveyors 35 or a right-hand bank of secondary tributary conveyors 36. Each bank of secondary tributary conveyors 35 and 36 is provided with a set of entrance gates 37 and 38, one gate at the entrance of each conveyor.

Figures 1B, 1C:
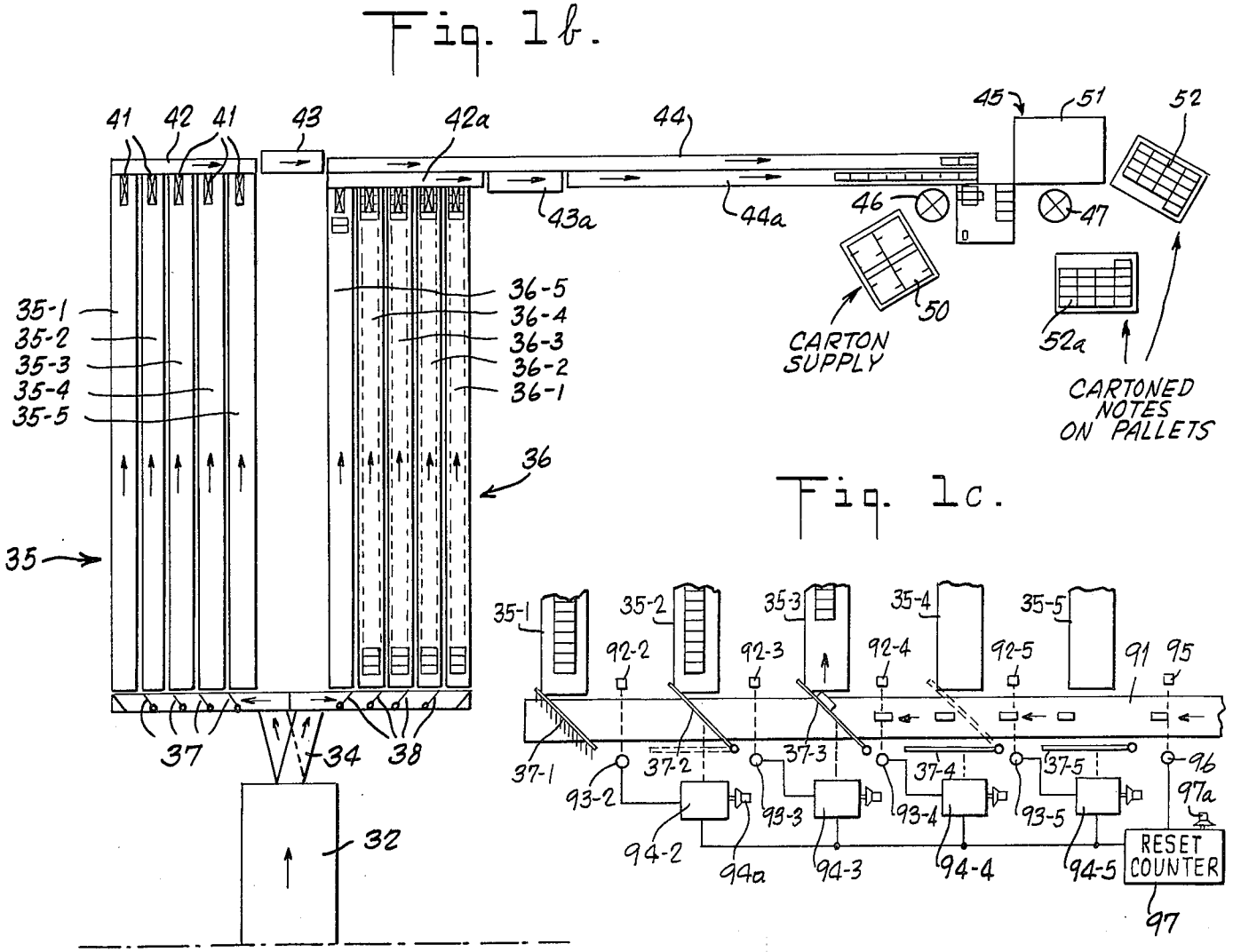

The entrance gates 37 for the secondary tributary conveyors 35 are spaced along an intermediate conveyor 91. The entrance gate 37-1 for conveyor 35-1 is fixed in position, so that all bundles approaching the gate 37-1 along the conveyor 91 are turned through a right angle and directed to the tributary conveyor 35-1. Between the conveyors 35-1 and 35-2, a lamp 92-2 directs a beam of light across the conveyor 91 onto a photocell 93-2, which actuates a counter 94-2 each time that a bundle interrupts the beam from the lamp 92. The counter is presettable by means of a knob 94a and controls a suitable motor (not shown) for operating a gate 37-2 at the entrance of tributary conveyor 35-2 from an open position shown in dotted lines in FIG. 1c to a closed position shown in full lines. Normally, the counter 94 will be preset to operate after all the bundles comprising one batch have moved on to the tributary conveyor 35-1. In the example illustrated, there are fifty bundles in one batch, so that the counter would be preset to close the gate 37-2 after fifty bundles have passed. Similarly, each of the conveyors 35-3, 35-4 and 35-5 is provided with a gate 37-3, 37-4 and 37-5 controlled respectively by preset counters 94-3, 94-4 and 94-5. Note that the counter 94-3 must be preset to 100 bundles, since it counts the bundles for both the conveyors 35-1 and 35-2. The counters 94-4 and 94-5 are set for 150 and 200 bundles, respectively. In other words, each counter closes its gate means after it has counted a number of bundles equal to the product of the number of piles in a stack times the number of second stage tributary conveyors downstream from the counter.

Another lamp 95, located beside the intermediate conveyor 91 upstream of all the conveyors 35, directs a beam of light toward a photocell 96 which controls a presettable counter 97, which is set to count 250 bundles and thereupon to operate a resetting mechanism for each of the counters 94-2, 94-3, 94-4 and 94-5. Thus, when all of the bundles from one batch have passed along the conveyor 91 and have been delivered to the conveyors 35-1 to 35-5, all of the gates 37-2 through 37-4 are reopened, and delivery of the next batch to the conveyors 35-1 to 35-5 can start immediately without waiting for the preceding batch to be delivered from those conveyors to the discharge conveyor 42. Note that any confusion between the last bundle of one batch and the first bundle in the following batch is automatically prevented by the one-only gates 41, which do not let the first bundles of the second batch pass until there is a bundle from that second batch ready for delivery at the gate 41 in the conveyor 35-5.

Generally speaking, it is desirable to control the diverting conveyor 34 so that bundles originating in the left-hand first stage tributary conveyors are delivered to the left-hand set of second stage tributary conveyors 35. Similarly, the bundles originating in the right-hand set of first stage tributary conveyors are delivered to the right-hand set of second stage tributary conveyors 36. The reason for the segregation between the left-hand sets of conveyors and the right-hand sets is that usually the left-hand sets will be handling a different block of numbers than the right-hand sets and it is necessary to maintain the separation so that the two blocks of numbers will not become confused. As long as the left and right-hand separation is maintained, the left-hand sets of conveyors may be handling an entirely different document than the right-hand sets of conveyors.

While the operation of the diverting conveyor 34 may be manual, as suggested above, it may be readily made automatic in response to a color code in the wrapping material or in the banding material. Alternatively, magnetic codes could be used in the wrapping material or the banding material and sensed by appropriate mechanisms to actuate the diverting conveyor 34. Either of these expedients would remove the burden of operating that conveyor from the operator at the banding station 32.

While, as stated above, it is generally desirable to maintain the flow of documents through the left-hand sets of conveyors separate from the flow through the right-hand set, it would be possible to operate the diverting conveyor so as to transfer documents from the left-hand set of first stage tributary conveyors to the right-hand set of second stage tributary conveyors, and vice versa. Since such an operation would tend to introduce confusion, it would normally not be desirable to operate the apparatus in that manner unless one stage of one set of conveyors was shut down, either for purposes of repair, or for some other reason.

At the discharge end of each tributary conveyor, there is provided a one-only gate 41 constructed and controlled in a manner similar to the gates 24 of the tributary conveyors 23. These gates deliver wrapped bundles from the secondary tributary conveyors 35 to a secondary main conveyor 42 and thence along a ramp conveyor 43 and a conveyor 44 to a packaging station generally indicated at 45. Similarly, the tributary conveyors 36 deliver to a secondary conveyor **42*a* and through a ramp conveyor 43a to a conveyor 44a. Two operators 46 and 47 man the packaging station 45. Operator 46 takes groups of packages from the conveyors 44 or 44a and transfers them to empty cartons 50 from a carton supply. The operator 47 takes the filled cartons and closes them in a carton sealing machine 51 and places them on an adjacent pallet 52** for removal by a lift truck.

FIGS. 4-8

These figures illustrate how the sequence of numbers on successive documents changes as the piles of documents are processed through the apparatus of FIGS. 1a and 1b.

Figure 10:
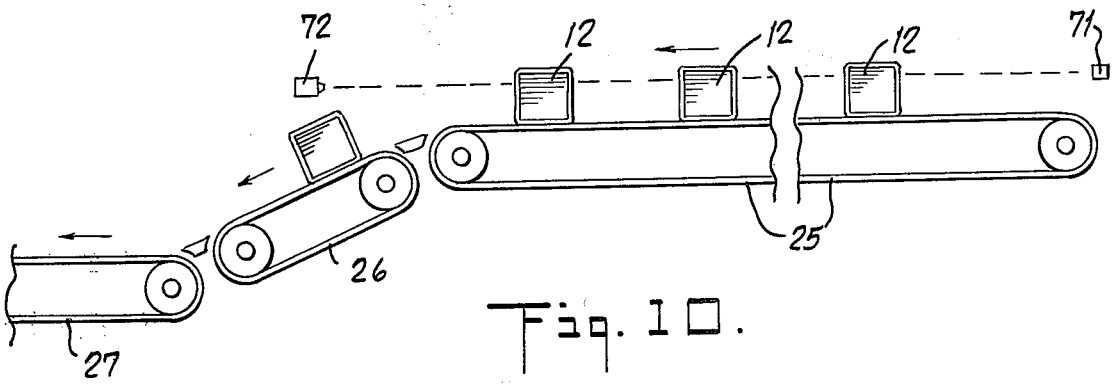
FIG. 10 is a diagrammatic view taken from the left in FIG. 9, showing the first stage main conveyor with part of a photoelectric control mechanism.

FIG. 4 shows the first banded pile 12 delivered from each of the four stacks 2-1 to 2-4 to the loading run 25 of the main conveyor. The first pile 12 from the stack 2-1 contains all the documents numbered from 000001 to 000500. The first pile from each of the other three stacks 2-2 to 2-4 contain documents numbered respectively from 000501 to 001000, to 001001 to 001500 and 001501 to 002000. Thus, the first time that the gates 24-1 to 24-4 are opened, there are delivered to the main conveyor 25 four piles of documents containing in consecutive numerical order all the documents numbered between 000001 and 002000. These are moved along the main conveyor and the gates 24 are not again opened until after the last banded pile appearing at the right-hand side of FIG. 4 has passed beyond the discharge end of the conveyor 25 (FIG. 10). These four piles 12 proceed to the wrapping station 30 where they are transferred to the conveyor 32 and wrapped in the wrapping machine 33, from which they emerge as a wrapped bundle 53 (FIG. 5).

The second set of four banded piles 14, is shown at the right-hand side of FIG. 5, where it is approaching the wrapper 33.

All the bundles 53 from the batch 3-1 consisting of the stacks 2-1 to 2-4 are directed to the same secondary tributary conveyor 36-1 appearing at the right-hand side of FIG. 1b. It may be seen that the successive bundles on the tributary conveyor 36-1 are in numerical order, but in a non-consecutive numerical order. More specifically, the first bundle contains all the documents from 000001 to 002000 and the second bundle contains all the documents from 010001 to 012000 and so on until the last of the fifty bundles contains all the numbers from 490001 to 492000. Thus, there is a gap of 10,000 numbers between the last document in any bundle and the first document in the following bundle.

Figure 8:
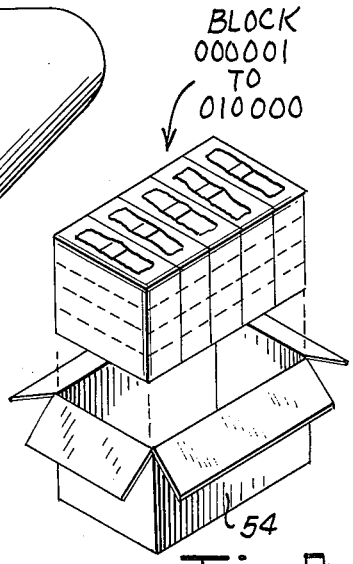
FIG. 8 is a perspective view of a package containing the group of documents on the conveyor of FIG. 7.

Subsequently, the batch 3-2 of FIG. 2 is passed through the banding stations and the wrapping station and delivered to the secondary tributary conveyor 36-2. Similarly, batch 3-3 is delivered to tributary conveyor 36-3, batch 3-4 is delivered to tributary conveyor 36-4 and batch 3-5 is delivered to tributary conveyor 36-5. The gates 41 at the discharge ends of the tributary conveyors 36 operate as "one only" gates, similarly to the gates 24, and as described below in connection with FIGS. 8-10.

Figure 7:
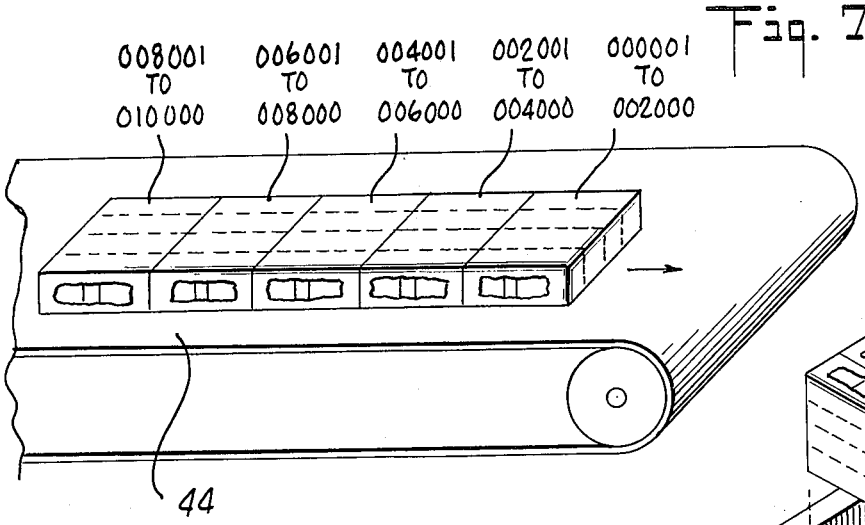
FIG. 7 is a perspective view showing the discharge end of the second stage main conveyor with a group of bundles thereon.

After the bundles are arrayed on the secondary tributary conveyors 36, as shown in FIG. 6. The first bundles adjacent to gates 41 on the five tributary conveyors contain in consecutive numerical order, all the documents numbered between 1 and 10000. Thus, when the gates 41 open so as to deliver one bundle from each conveyor to the main conveyor 44a, the main conveyor receives a group of five consecutive bundles which contain, in consecutive order, all the numbered documents between 1 and 10000. As shown in FIGS. 1b and 7, this group of five bundles is carried together along the conveyors 43*a* and 44*a* to the packaging station, where they are placed in a carton 54. The carton is then sealed and becomes one of the final packages ready for delivering to a customer.

Note that the gates 41 will start opening to deliver bundles to the main conveyor only after all the conveyors 36-1 to 36-4 are filled and at least one bundle has reached gate 41 on conveyor 36-5. Thereafter, the delivery to the main conveyor will continue as long as bundles are available at gate 41 on conveyor 36-5.

FIGS. 9-11

Figure 9:
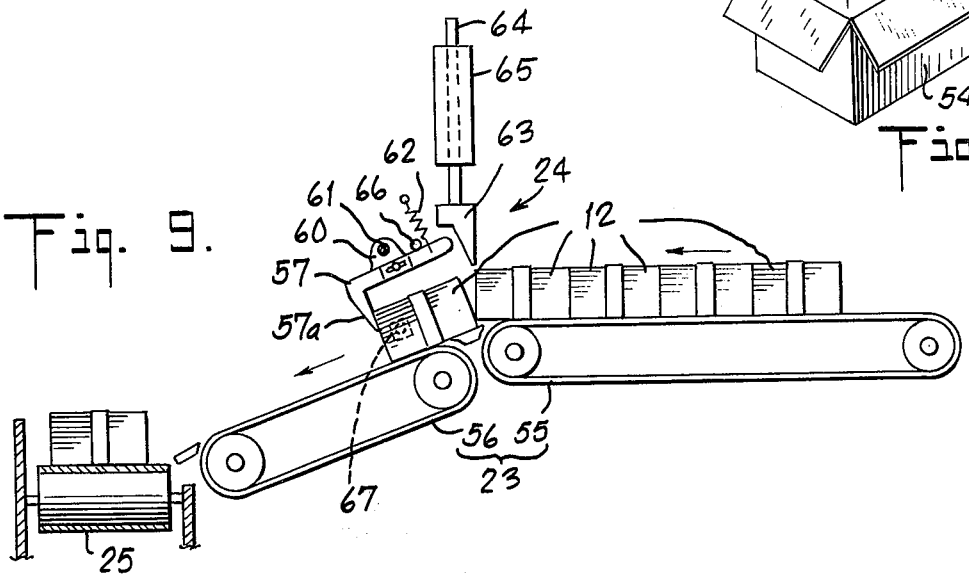
FIG. 9 is a diagrammatic illustration of one of the first stage tributary conveyors showing the one-at-a-time gate mechanism.

These figures illustrate the operation of the one-only gate mechanism 24. As best seen in FIG. 9, each conveyor 23 comprises a horizontal run 55 and a diagonally downward run 56. The gate mechanism 24 includes a primary gate comprising an L-shaped member 57 adjustably mounted on arm 60, which is pivoted on a stationary shaft 61. A spring 62 biases the member 57 for rotation counterclockwise about the shaft 61 and against a stop 66. In the position shown in FIG. 9, an arm 57*a* of the member 57 extends downwardly into the path of the leading banded pile 12. The gate mechanism 24 also includes a secondary gate member 63 fixed on an armature 64 operated by electromagnet 65. The gate member 63 is biased by a spring (not shown) to the position illustrated in FIG. 9, in which the secondary gate member 63 is above the path of the banded piles 12 and is also free of the right-hand end of the member 57.

When the electromagnet 65 is energized, the secondary gate member 63 is moved downwardly into the path of the banded piles 12 on the horizontal conveyor run 55. The gate member 63 also engages the right-hand end of the member 57, moving it clockwise about the pivot shaft 61, far enough so that the arm 57*a* moves out of the path of the leading banded pile 12 which appears at the top of the diagonal conveyor run 56. That pile 12 then moves down the conveyor 56 to the loading run 25 of the main conveyor.

Figure 11:
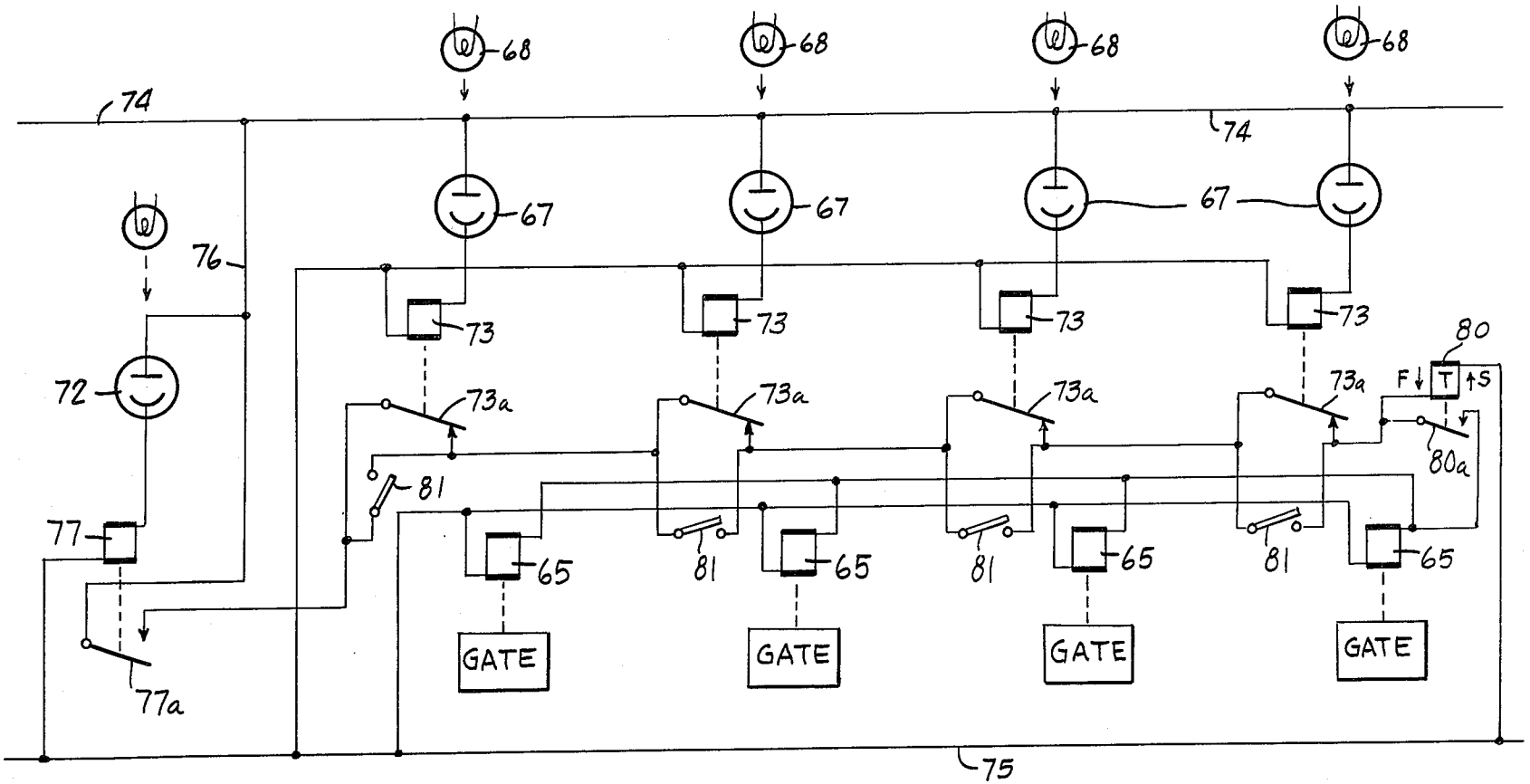
FIG. 11 is a wiring diagram showing a control system for the gates of all of the first stage tributary conveyors.

The leading banded pile 12, in the position shown in FIG. 9, interrupts the path of light between a photocell 67 and a light source 68 (see FIG. 11). The banded piles 12, upon reaching the loading run 25 of the main conveyor move into the path of a light beam between another light source 71 (FIG. 10) and a photocell 72. This light beam remains blocked until all of the banded piles 12 from the four tributary conveyors 24 have passed from the loading run 25 on to a diagonally downward run 26 so as to clear the path of the beam between the source 71 and photocell 72.

FIG. 11 shows a wiring diagram of the circuits by which the photocells 67 and 72 control the electromagnets 65.

Each of the photocells 67 is shown as being connected in series with a relay winding 73 between a position power supply line 74 and a negative power supply line 75. Similarly, photocell 72 is connected in series with a relay 77, between the same supply lines. It should be understood that this series circuit is selected for purposes of simplicity of illustration only, and that, in any practical circuit, a suitable amplifier would be introduced between each photocell and its relay. Each relay 73 controls a back contact 73a, i.e., a contact which is closed when the relay is de-energized. The back contacts 73a are all connected in a series circuit which may be traced from the positive power line 74 through a conductor 76, a front contact 77a of relay 77 and thence through all the contacts 73*a* in series, and a winding 80 of a time-delay relay to the negative power supply line 75. The time-delay relay 80 has a front contact 80*a* which completes a circuit which may be traced along the last traced circuit to the contact 80*a* and thence through the windings of all the electromagnets 65 in parallel to the negative power supply line 75.

A manually operable switch 81, normally open, is connected in parallel with each of the contacts 73*a*.

When the photocells 67 are all blocked by banded piles 12 standing between them and their source of light, then the relays 73 are all de-energized and the contacts 73*a* are all closed. If the loading run 25 of the main conveyor is then clear of banded piles 12, the photocell 72 is not blocked and the relay 77 is energized. Contact 77*a* is thereby closed and the time-delay relay 80 is energized. After a predetermined time, it closes its contact 80*a*, opening all the gates 24 to deliver one banded pile from each gate to the main conveyor 25.

As soon as the leading piles 12 pass beyond the photocells 67, those photocells are again illuminated and the relays 73 open their contacts 73*a* thereby de-energizing the time-delay relay 80, so that the electromagnets 65 are all de-energized and the secondary gate members 63 return to the positions shown in FIG. 9, so that the next banded pile in line advances to the position at the top of the diagonal conveyor 56 and is held there by the gate 57.

The time-delay relay 80 is provided so that there will be a sufficient interval after the gate member 57 is once opened, before it can be opened again, in order to give the banded piles 12 time to travel down the conveyors 56 to the main conveyor 25. Otherwise, it might occur that the second piles 12 in line on all the tributary conveyors might reach the gate members 57 on all the conveyors before any of the banded piles 12 had advanced down the conveyors 56 to a position where they could block the light beam impinging on the photocell 72. If that occurred, there might take place a second opening of the gates 24 before the banded piles 12 from the first opening had cleared the loading run 25 of the main conveyor. Consequently, the banded piles from the second opening of the gates 25 might come down on the loading run 25 between some of the banded piles from the first opening of those gates, so that the banded piles on the main conveyor would not then be in numerical order.

The manual switches 81 are provided so that they may be closed in the event it is desired, for a particular log, not to use all of the tributary conveyors. Such an operation is described below in connection with FIG. 12.

FIG. 12

Figure 12:
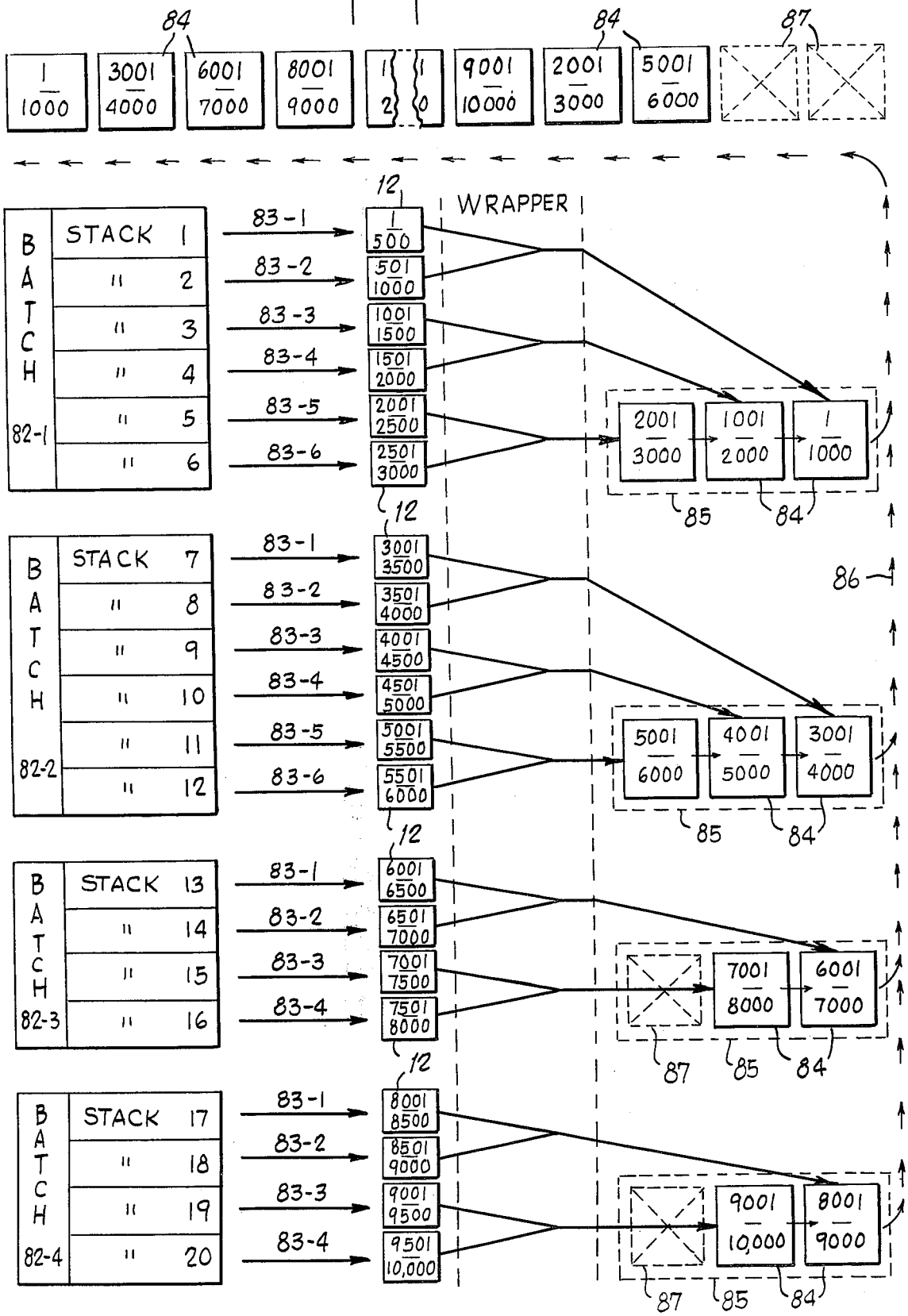
FIG. 12 is a diagrammatic illustration of a different sequence of operation of the tributary conveyors which may be used in a modification of the method of the invention.

In the preceding embodiment of the invention, the number of tributary conveyors 23 employed (four) was exactly equal to the number of stacks in each batch. In the embodiment of FIG. 12, the same total number of stacks is employed, but they are separated into batches of different size. The first two batches are shown at 82-1 and 82-2, and each consists of six stacks. The second two batches are shown at 82-3 and 82-4 and each consist of four stacks. The first stage tributary conveyors comprise six tributary conveyors 83-1 to 83-6, all of which are used in connection with the first two batches, and only four of which are used in connection with the second two batches.

When utilizing the invention in connection with batches having unequal numbers of stacks, those tributary conveyors 83 which are not used on a given batch must be shut down and the switches 81 of those tributary conveyors must be closed, so as to keep their gates 65 from interfering with the operation of the gates on the operating tributary conveyors. The largest number of banded piles 12 which can be wrapped together as one bundle in this embodiment, must be equal to the largest whole number which is evenly divisible into the number of stacks in all the batches. In the case of FIG. 12, that number is two so that there are two banded piles 12 in each bundle 84. In any case, the number of piles in a bundle may always be made one.

The bundles from the first batch 82-1 reach the first secondary tributary conveyor 85 in a fashion such that three consecutive bundles have their documents numbered consecutively, but there is a gap between the last number in that group of bundles and the first number of the next following group on the same conveyor. This gap is filled by the first group of three bundles on the second secondary tributary conveyor and groups of two bundles each on the third and fourth secondary tributary conveyors 85.

Upon the first opening of the gates (not shown) at the discharge ends of the tributary conveyors 85, the bundles 84 containing numbers 1-1000, 3001-4000, 6001-7000 and 8001-9000 are discharged on to the main conveyor 86. Upon the second opening, the bundles 84 containing numbers 1001-2000, 4001-5000, 7001-8000 and 9001-10000 are discharged. Upon the third opening, bundles 84 containing numbers 2001-3000 and 5001-6000 are discharged, together with two dummy bundles 87 of distinctive appearance from the last two tributary conveyors 85.

The result is that the bundles reaching the secondary main conveyor in sequence include all the documents bearing all the numbers within a consecutively numbered set, i.e., the set from 1-1000. Similarly, each subsequent group of ten bundles will include documents bearing all the numbers within a consecutively numbered set and each set will be consecutive with the preceding set. The dummy bundles, inserted at the wrapping station to preserve numbering sequence, are removed at the packing station and returned to the wrapping station for re-use.

GLOSSARY

A "lot" is the term used herein to define all of the bank notes or other documents printed in one consecutive sequence of numbers.

A "batch" is the largest subdivision of a lot, and must be less than the capacity of one secondary tributary conveyor. Preferably, all the batches in one lot will be of equal size as in the species of FIGS. 1-11, but they may be of unequal size, as in the species of FIG. 12.

A "stack" is a subdivision of a batch chosen for a convenient size in the cutting, banding and other handling operations. Typically, a stack will consist of 500 sheets.

A "pile" is one of the subdivisions into which a stack is cut. It consists of single notes or documents, all of which are in consecutive numerical order. If there are 50 documents on a sheet, there will be fifty piles cut from a stack.

A "banded pile" is a pile with a band fastened around it to hold it together for transportation and handling.

A "bundle" is a group of banded piles wrapped together usually with a transparent wrapper.

A "package" is a group of bundles packed together, usually in a carton.

The term "array", as used in this specification, is generic to the term pile and bundle.

The term "assemblage", as used in this specification, is generic to the terms pile, bundle and package.

We claim:

1. Method of assembling distinctively numbered documents in separate assemblages, each assemblage including a multiplicity of documents bearing all numbers within one of a multiplicity of consecutive sets, said documents being derived from a lot consisting of a multiplicity of stacks of multiple document sheets, in which lot the documents in corresponding locations of successive sheets are numbered in consecutive numerical order, the documents on each sheet are arranged by rows and columns and are numbered in a nonconsecutive numerical order in which successive members of the order bear numbers separated by a fixed difference, and the numbers on the first sheet in each stack follow consecutively the numbers on the last sheet in the preceding stack, comprising:

a. subdividing each stack into a plurality of arrays of individual documents, with only one document from one sheet in each array, the documents of each array being numbered consecutively;

b. transferring the arrays from each stack to one of a plurality of tributary conveyors in said nonconsecutive order so that the number on the first sheet in each array is separated from the number on the first sheet in the next array by said fixed difference; said tributary conveyors being equal in number to the number of stacks in a lot, so that the arrays in each group of corresponding positions on the tributary conveyors include documents bearing all numbers within one of said consecutive sets;

c. delivering simultaneously one array from one group of corresponding positions on all the tributary conveyors to consecutive locations along a main conveyor;

d. moving each group of simultaneously delivered arrays along the main conveyor to a locality beyond the tributary conveyors before repeating the delivering step (c);

e. repeating steps (c) and (d) until all the arrays from said groups of corresponding positions on the tributary conveyors are transferred to the main conveyor; and f. removing each said group of arrays from the main conveyor as a consecutively numbered assemblage.

2. Method of claim 1, in which the transferring step is accomplished by placing in corresponding positions on adjacent tributary conveyors arrays in which the consecutive order is continuous from an array on one conveyor to an array in a corresponding position on the next conveyor, and the arrays in successive positions on each tributary conveyor bear number sequences which are separated by said fixed difference.

3. Method of claim 1, in which the corresponding positions include different numbers of positions on different tributary conveyors.

4. Method of assembling in numerical order a multiplicity of distinctively numbered documents from a lot consisting of a multiplicity of stacks of multiple document sheets, in which lot the documents in corresponding locations of successive sheets are numbered in consecutive numerical order, and the documents on each sheet are arranged by rows and columns and are numbered in a non-consecutive numerical order, in which successive members of the order bear numbers separated by a fixed difference equal to the number of sheets in a lot, comprising:

a. subdividing the lot into a plurality of consecutive batches;

b. further subdividing each batch into a plurality of consecutive stacks;

c. separating each stack into piles of individual documents, with only one document from one sheet in each pile, and the documents in each pile numbered consecutively;

d. transferring all the piles from the respective consecutive stacks, one pile at a time, in said non-conductive numerical order, to respective ones of a plurality of consecutively arranged tributary conveyors, equal in number to the number of stacks in a batch;

e. delivering simultaneously one pile from each tributary conveyor to consecutive locations along a main conveyor to form there a group of consecutive piles in which the documents are numbered consecutively;

f. moving the group of consecutive piles on the main conveyor beyond all the tributary conveyors before repeating the delivering step;

g. repeating steps (c), (d), (e) and (f) until the batch is exhausted, thereby forming on the main conveyor groups of consecutive piles, with the numbers on the documents in each group separated from the numbers on the documents in the next group by said fixed difference; and then h. repeating steps (b) through (g) until the lot is exhausted.

5. Method as in claim 4, including the further steps of:

a. delivering each group of consecutive piles on the main conveyor as a unitary bundle;

b. delivering all the bundle derived from the respective consecutive batches to respective ones of a series of consecutively arranged secondary tributary conveyors equal in number to the number of batches in the lot, thereby forming on each tributary conveyor a consecutive series of bundles, in each of which the documents are consecutively numbered, and in which the numbers on the documents in each bundle are separated from the numbers on the documents in the next group by said fixed difference;

c. delivering simultaneously one bundle from each secondary tributary conveyor to consecutive locations along a secondary main conveyor so that each bundle contains consecutively numbered documents, one from each sheet in the lot, and the documents in successive bundles are numbered consecutively;

d. moving said simultaneously delivered bundles on the secondary main conveyor beyond all the secondary tributary conveyors before repeating the delivering step (c); and e. removing a plurality of bundles discharged consecutively from said secondary main conveyor as an array of consecutively numbered documents.

6. Method as in claim 5, in which all batches in said lot have the same number of stacks, and each final package has the documents within a consecutively numbered set arranged in numerically consecutive order.

7. Method as in claim 5, in which at least one batch has a different number of stacks than the other batches, and each final package contains the documents bearing all numbers within a consecutively numbered set, but not in consecutive order.

* * * * *

UNITED STATES PATENT OFFICE

CERTIFICATE OF CORRECTION

Patent No. 3,982,453 Dated September 28, 1976

Inventor(s) Salvatore F. D'Amato and Francis T. Moss

It is certified that error appears in the above-identified patent and that said Letters Patent are hereby corrected as shown below:

Col. 4, line 15, "opposite" is misspelled

Col. 7, line 6, "Fig. 6. The" should read: -- Fig. 6, the --.

Col. 11, lines 32 and 33, "non-con-ductive" should read:

-- non-con-secutive --.

Signed and Sealed this

Twenty-fifth Day of January 1977

[SEAL]

*Attest:*

RUTH C. MASON
*Attesting Officer*

C. MARSHALL DANN
*Commissioner of Patents and Trademarks*